US009849339B1

(12) United States Patent
Stanley

(10) Patent No.: US 9,849,339 B1
(45) Date of Patent: Dec. 26, 2017

(54) BODY FIN FOR SWIMMING

(71) Applicant: Donald Stanley, Portland, OR (US)

(72) Inventor: Donald Stanley, Portland, OR (US)

( * ) Notice: Subject to any disclaimer, the term of this patent is extended or adjusted under 35 U.S.C. 154(b) by 0 days.

(21) Appl. No.: 15/238,915

(22) Filed: Aug. 17, 2016

(51) Int. Cl.
*A63B 31/10* (2006.01)
*A63B 31/12* (2006.01)

(52) U.S. Cl.
CPC ..... *A63B 31/12* (2013.01)

(58) Field of Classification Search
CPC ..... A63B 31/12
USPC ..... 441/59, 60
See application file for complete search history.

(56) References Cited

U.S. PATENT DOCUMENTS 1,839,489 A * 1/1932 Meroussis ..... A63B 31/12 441/59
3,015,829 A * 1/1962 Gronkowski ..... A63B 31/12 441/59
9,493,218 B2 * 11/2016 Gadler ..... B63B 35/79

* cited by examiner

*Primary Examiner* — Stephen Avila
(74) *Attorney, Agent, or Firm* — Mohr Intellectual Property Law Solutions, PC

(57) ABSTRACT

The invention relates a body fin for aiding in maneuvering a swimmer through water. The body fin comprises an upper body member adapted to be attached around sections of a human forearm, upper arm, shoulder, back and waist. The body fin also includes a lower body member that can be attached around a human waist, thigh, and ankle. The lower body fin includes a flexible fin having a first area contoured with a front side of the waist, thigh, and ankle and a second area extending away from the first section and the surface of the thighs and ankle. The upper body member also includes a first flexible fin extending from the surface of the forearm and a second flexible fin extending from the surface of the upper arm, shoulder, and waist, the ends of the first flexible fin terminating substantially at the surface of the sections.

20 Claims, 2 Drawing Sheets

BODY FIN FOR SWIMMING

TECHNICAL FIELD

The present invention relates to swimming aids and more specifically to a body fin that can be worn by a swimmer to aid the swimmer in more efficiently swimming through water.

BACKGROUND

In the art of propelling oneself through water, it is desirable to use swimming aids, such as fins and flippers that can be attached to the user's body. The uses for these aids can either be in everyday swimming activities for recreational purposes or in sports activities, such as scuba diving, or military maneuvers, such as frogman operations. As such, it is common practice to wear feet flippers and fins for your hands and feet for this purpose.

In the stated art, the fins and flippers are usually designed to attach to a segment of the body, e.g. the hands and forearm or the foot and calf. This is effective to get from point a to point b and is more efficient than without the fins and flippers. A reason for designing the fins and flippers for attachments to segments of the body is to propel the user through the water more efficiently but also without too strictly limiting the user's ability to use their hands, feet, and limbs.

However, a limitation of these types of fins of flippers is that they do not provide optimal use of the body when a user is propelling themselves through the water. For example, in some use cases, such as an emergency situation, there may be a need to not only propel yourself through the water but do so at optimal speed. For example, in an emergency situation, such as someone stranded at sea or other large body of water, one may benefit from a fin and flipper set that could make optimum use of the body to get from point a stranded boat to a beach as quickly as possible.

As such, there is a need for a body fin that can be used by swimmers to more efficiently propel themselves through water.

SUMMARY

The present invention is directed to a body fin constructed in accordance with the teachings of this invention.

The present invention overcomes the disadvantages of the prior art by providing a full body fin designed to be worn by a user and attached to the body similar to a vest and a pair of pants and to further provide fins along a surface area of the body to optimize propulsion through water.

According to this invention, the body fin includes a first upper body member adapted to be attached around sections of a human forearm, upper arm, shoulder, back and waist. The body fin further includes a lower body member that is adapted to be attached around a human waist, thigh, and ankle.

According to this invention, the upper body member includes a first flexible fin extending from the surface of the forearm and a second flexible fin extending from the surface of the upper arm, shoulder, and waist. The ends of the first and second flexible fin terminating substantially at the surface of the sections defined by the forearm, upper arm, shoulder, and waist. The second flexible fin comprises a continuous rigidizing muscular rib portion of the fin. The rib portion of the second fin extends outwardly so as to become rigid when stretched into a first position and to recede into a relaxed position in a second position.

According to this invention, a lower body fin comprises a flexible fin that has a first area contoured with a front side of the waist, thigh, and ankle and a second area that extending away from the first section and the surface of the thigh and ankle; effectively forming a shape that is narrow along the waist and thighs and extends outwardly around the knees and ankles, forming a fin.

DETAILED DESCRIPTION

Figure 1A:
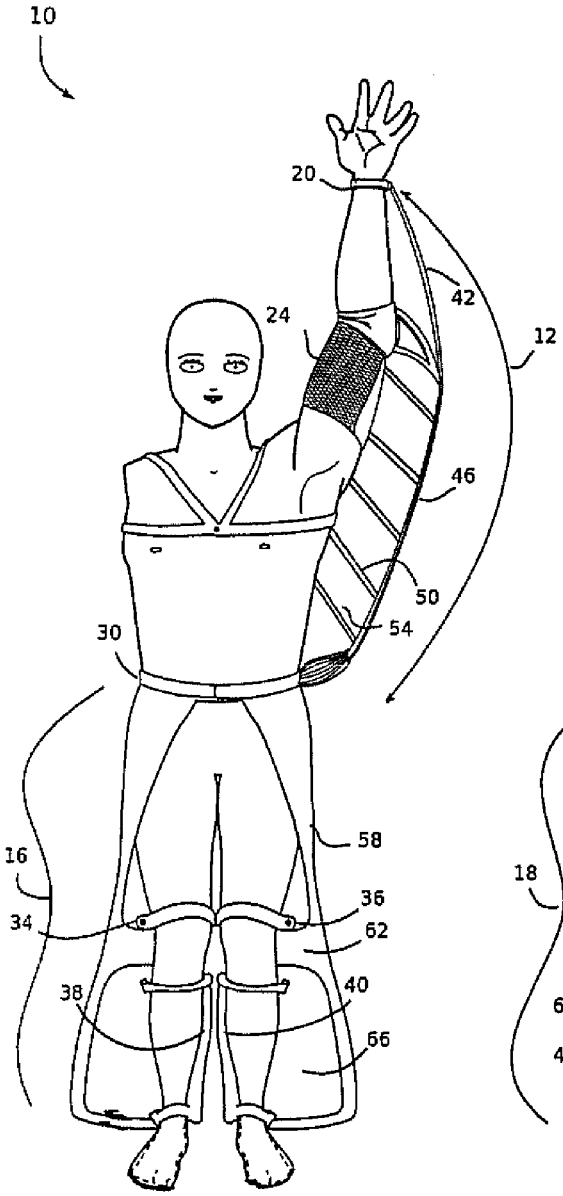
FIG. 1A is a front view of a body fin according to an embodiment of the invention.
Figure 1B:
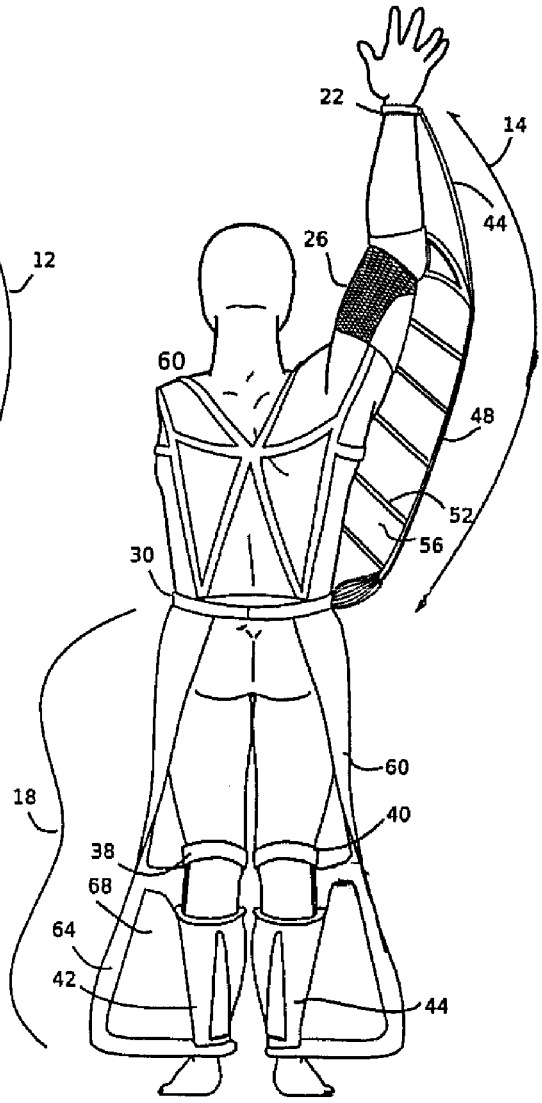
FIG. 1B is back view of the body fin according to an embodiment of the invention body fin.

Referring to FIGS. 1A and 1B, a basic structure of a swimming fin is illustrated according to the teachings of the invention and is denoted generally as 10. In FIG. 1A, a front view of swimming fin 10 is illustrated. In FIG. 1B, a back view of the swimming fin 10 is illustrated. The fin 10 includes a upper body fin 12 for one side of the arm and torso and another body fin 14 for the other side of the arm and torso. Fin 10 further includes a lower body fin 16 illustrated in FIG. 1A as the lower body fin 16 worn by the swimmer with the fin positioned behind the legs. In FIG. 1B, a lower body fin 18 is illustrated with the fin positioned in the front of the legs. The fin 10 may be constructed of a soft, elastic, rubber-like material that can be stretched about apertures to form a suite that can fit at the wrist, elbow, upper arm, waist, and knees and ankles to form a body fin in the fashion shown in FIGS. 1A and 1B. It should also be understood that the fin 10 is separable into upper body fin 12,14 and lower body fin 16,18 and can be worn together or separately.

The upper body fin 12,14 includes wrist straps 20,22 that can be stretched about a wrist, a bodice section 24,26 stretched about the elbow and upper arm, and a waist strap 30 stretched about the waist. The lower body fins 16,18 include upper knee straps 34,36 for FIG. 1A and knee straps 38,40 for FIG. 1B and shin strips 38,40 for FIG. 1A and shin straps 42,44 for FIG. 1B that can be attached at the lower knee and ankles. The lower body fins 16,18 can also be attached with the waist strap 30.

The upper body fins 12,14 further include a flexible forearm fin 42,44 that is attached at the wrists and elbows. The upper body fin also includes a flexible upper arm and torso fin 46,48 that is attached at the elbow and waist. Fins 42,44 extend from the surfaces along the forearm and maybe more rigid than fins 46,48 so as to allow the swimmer to more effectively propel and maneuver themselves through the water. The upper arm and torso fin 46,48 may include ribbed edges 50,52 wherein over a greater part of the surface is substantially a flexible membrane member 54,56. In an alternative embodiment, the forearm fins 42,44 may also include ridges and a membrane member. The upper arm and torso fins 46,48 will drop into a relaxed position or a feathered position when the arm is relaxed and at a swimmer's side. The fins 46,48 will become taut and rigid when the swimmer's arms are stretched and remains taut during a power stroke. The fins 42,44,46,48 when attached provide for an improved upward and downward power-swimming stroke, e.g. a sinusoidal swimming stroke, when the swimmer uses the upward and downward force of the body to propel him or herself through water.

The lower body fins 16,18 further include a lower body member 58,60 attached to waist strap 30, upper knee straps 34,36,38,40 and shin strips 38,40,42,44 that can be attached at the lower knee and ankles. The lower body members 58,60 further includes a multi-component fin that comprises a flexible soft, elastic, rubber-like material 62,64 and a semi-rigid plate 66,68, such as plastic. The combination of the fin provides the swimmer with the flexibility of a traditional fin to propel the user through water but also the additional rigidity needed to create propulsion to overcome the force needed for a body fin as illustrated.

Figure 2A:
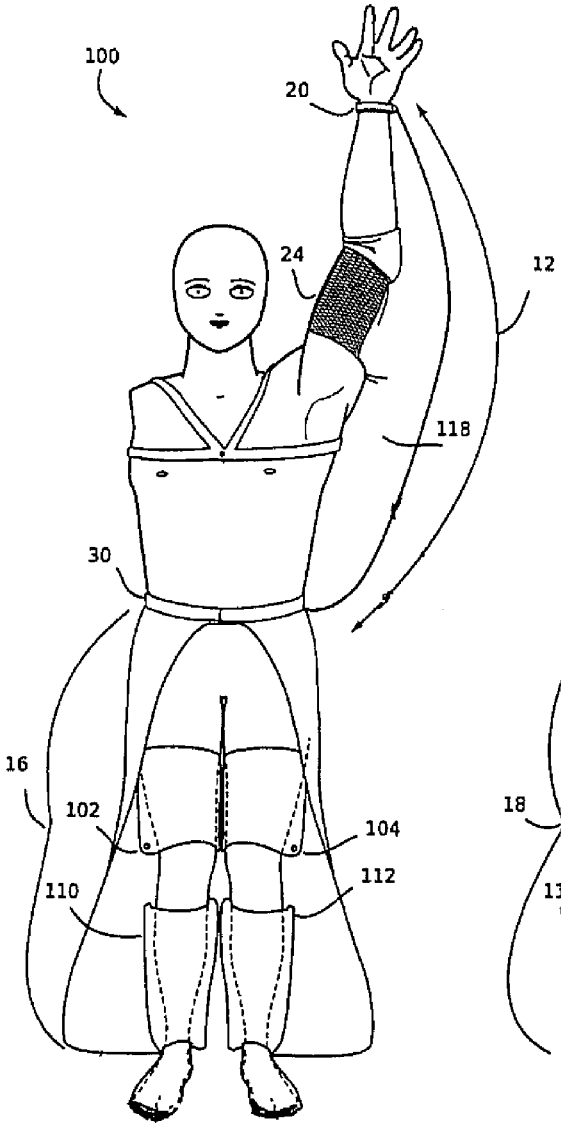
FIG. 2A is a front view of a body fin according to an alternative embodiment of the invention.
Figure 2B:
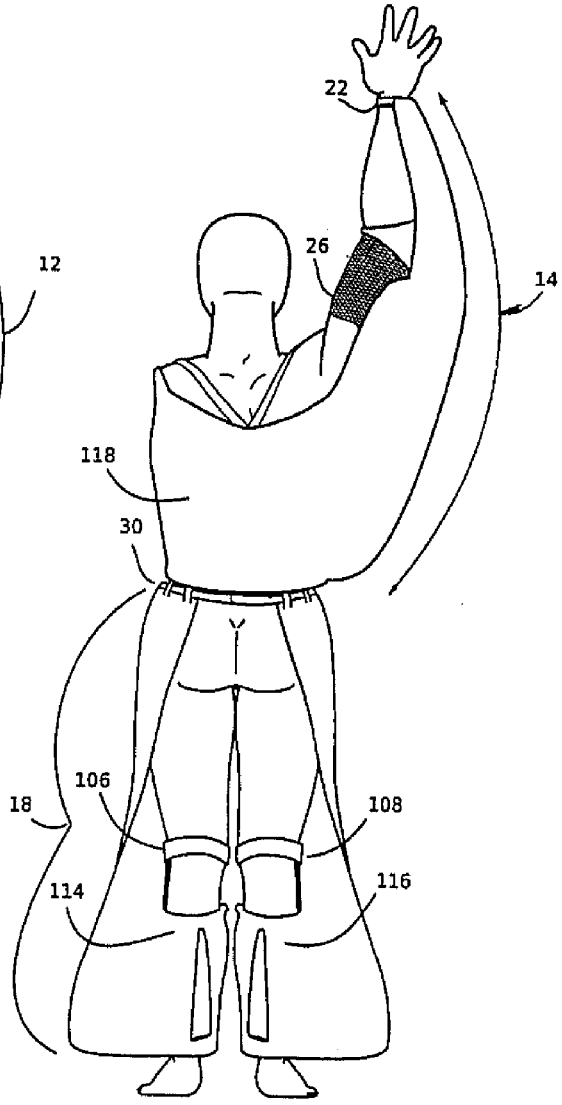
FIG. 2B is a back view of a body fin according to an alternative embodiment of the invention.

Referring now to FIGS. 2A and 2B, a basic structure of additional materials for use with swimming fin 10 is illustrated according to teachings of the invention and is denoted generally as 100. In FIGS. 1A and 1B, swimming fin 10 is illustrated to show the skeletal structure of the fin fitted to a swimmer's body. As such and for the sake of brevity, only additional features beyond what is illustrated in FIGS. 1A and 1B, which features of FIGS. 1A and 1B are incorporated in reference to FIGS. 2A and 2B, will be discussed. In FIGS. 2A and 2B, the additional materials is in the form of an outer skin that is formed with or fastened to the skeletal structure of swimming fin 10.

In FIG. 2A, a front view of swimming fin 100 is illustrated. In FIG. 1B, a back view of the swimming fin 100 is illustrated. The fin 100 includes upper body fin 12 with for one side of the arm and torso and the other body fin 14 for the other side of the arm and torso. Fin 100 further includes the lower body fin 16 illustrated in FIG. 2A as the lower body fin 16 worn by the swimmer with the fin positioned behind the legs. In FIG. 2B the lower body fin 18 is illustrated with the fin positioned in the front of the legs. Parts of the fin 100 may be constructed of a soft, elastic, rubber-like material that can be stretched about apertures to form a suite that can fit at the wrist, elbow, upper arm, waist, and knees and ankles to form a body fin in the fashion shown in FIGS. 2A and 2B. Other parts, e.g. the outer skin, may be made of a combination of rubber-like material and cloth. It should also be understood that the fin 100 is separable into upper body fin 12,14 and lower body fin 16,18 and can be worn together or separately.

The upper body fins 12,14 include wrist straps 20,22 that can be stretched about a wrist, a bodice section 24,26 stretched about the elbow and upper arm, and a waist strap 30 stretched about the waist. The lower body fins 16,18 include thigh straps 102,104 for FIG. 2A and thigh straps 106,108 for FIG. 2B that can be stretched about the thighs. The lower body fins 16,18 further include shin strips 110,112 for FIG. 2A and shin straps 114,116 for FIG. 2B that can be stretched about the shins. The lower body fins 16,18 can be attached with the waist strap 30.

The upper body fins 12,14 further include a outer skin member 118 that integrates with the wrist straps 20,22, bodice section 24,26, and waist strap 30 and surrounds and continues upper body fins 12,14 along the length of the arm, shoulder and back. The outer skin member 118, the knee straps 106,108, and shin strips 110,112 provide the user with a full body fin that more tightly fits with the contours of the body. As such, the swimming fin provides the user with the ability to more easily propel themselves through water and also remains more closely attached to the user's body. That is to say, the swimming fin 100 provides a more secure fit to the swimmer's body.

Thus, While there have been shown and described and pointed out fundamental novel features of the invention as applied to a preferred embodiment thereof, it Will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are Within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

The invention claimed is:

1. A swimming apparatus comprising:

an upper body member adapted to be attached around sections of a human wrist, forearm, upper arm, shoulder, back and waist for aiding in maneuvering the same through water;

a lower body member adapted to be attached around a human waist, thigh, and ankle and comprising a tail fluke having a first area contoured to hug a front side of the waist, thigh, and ankle and a second area extending laterally from the thigh and ankle; and the upper body member comprising a flexible membrane extending from the wrist to the waist, the flexible membrane being supported by a skeletal structure;

the skeletal structure comprising a plurality of ribs spaced apart and extending laterally from the upper arm and shoulder.

2. The swimming apparatus of claim 1 wherein the upper body member is configured to form a continuous wing extending laterally from the wrist to the waist when the forearm is extended upwardly.

3. The swimming apparatus of claim 2 wherein the upper body member is configured to recede into a relaxed position when the forearm is held in a relaxed position near the waist.

4. The swimming apparatus of claim 1 wherein the plurality of ribs is a first plurality of ribs and wherein the skeletal structure comprises a second plurality of ribs spaced apart and extending laterally from the forearm.

5. The swimming apparatus of claim 4 wherein the second plurality of ribs extends outwardly so as to become rigid when the forearm is fully extended upwardly and to recede into a relaxed position when the forearm is held in a relaxed position near the waist.

6. The swimming apparatus of claim 1 wherein the skeletal structure comprises a semi-rigid fin extending laterally from the forearm.

7. The swimming apparatus of claim 1 comprising a wrist strap configured to secure the flexible membrane to the wrist.

8. The swimming apparatus of claim 1 comprising an upper arm sleeve configured to secure the flexible membrane to the upper arm.

9. The swimming apparatus of claim 1 wherein the skeletal structure is a first skeletal structure, the tail fluke comprising a second skeletal structure, wherein the second skeletal structure comprises a semi-rigid plate extending laterally from the ankle.

10. The swimming apparatus of claim 9, wherein the flexible membrane is first flexible membrane, the tail fluke comprising a second flexible membrane extending from the ankle, over the rigid plate, and to the waist.

11. A swimming apparatus comprising:

an upper body member adapted to be attached around sections of a human wrist, forearm, upper arm, shoulder, back and waist for aiding in maneuvering the same through water;

the upper body member comprising a flexible membrane extending from the wrist to the waist, the flexible membrane being supported by a skeletal structure;

the skeletal structure comprising a plurality of ribs spaced apart and extending laterally from the upper arm and shoulder;

wherein the upper body member is configured to form a continuous wing extending laterally from the wrist to the waist when the forearm is fully extended upwardly;

wherein the upper body member is configured to recede into a relaxed position when the forearm is held in a relaxed position near the waist; and a lower body member adapted to be attached around a human waist, thigh, and ankle and comprising a tail fluke having a first area contoured to hug a front side of the waist, thigh, and ankle and a second area extending laterally from the thigh and ankle.

12. The swimming apparatus of claim 11 wherein the upper body member is configured to recede into a relaxed position when the forearm is held in a relaxed position near the waist.

13. The swimming apparatus of claim 11 wherein the plurality of ribs is a first plurality of ribs and wherein the skeletal structure comprises a second plurality of ribs spaced apart and extending laterally from the forearm.

14. The swimming apparatus of claim 13 wherein the second plurality of ribs extends outwardly so as to become rigid when the forearm is fully extended upwardly and to recede into a relaxed position when the forearm is held in a relaxed position near the waist.

15. The swimming apparatus of claim 11 wherein the skeletal structure comprises a semi-rigid fin extending laterally from the forearm.

16. The swimming apparatus of claim 11 comprising a wrist strap configured to secure the flexible membrane to the wrist.

17. The swimming apparatus of claim 11 comprising an upper arm sleeve configured to secure the flexible membrane to the upper arm.

18. The swimming apparatus of claim 11 wherein the skeletal structure is a first skeletal structure, the tail fluke comprising a second skeletal structure, wherein the second skeletal structure comprises a semi-rigid plate extending laterally from the ankle.

19. The swimming apparatus of claim 18, wherein the flexible membrane is first flexible membrane, the tail fluke comprising a second flexible membrane extending from the ankle, over the semi-rigid plate, and to the waist.

20. A swimming apparatus comprising:

an upper body member adapted to be attached around sections of a human wrist, forearm, upper arm, shoulder, back and waist for aiding in maneuvering the same through water;

the upper body member comprising a first flexible membrane extending from the wrist to the waist, the flexible membrane being supported by a first skeletal structure;

the first skeletal structure comprising a plurality of ribs spaced apart and extending laterally from the upper arm and shoulder;

wherein the upper body member is configured to form a continuous wing extending laterally from the wrist to the waist when the forearm is fully extended upwardly;

wherein the upper body member is configured to recede into a relaxed position when the forearm is held in a relaxed position near the waist;

a lower body member adapted to be attached around a human waist, thigh, and ankle and comprising a tail fluke having a first area contoured to hug a front side of the waist, thigh, and ankle and a second area extending laterally from the thigh and ankle;

wherein the tail fluke comprises:

a second skeletal structure, wherein the second skeletal structure comprises a semi-rigid plate extending laterally from the ankle; and a second flexible membrane extending from the ankle, over the semi-rigid plate, and to the waist.

* * * * *